US007952533B2

(12) United States Patent
Hur et al.

(10) Patent No.: US 7,952,533 B2
(45) Date of Patent: May 31, 2011

(54) ANTENNA ELEMENT AND FREQUENCY RECONFIGURATION ARRAY ANTENNA USING THE ANTENNA ELEMENT

(75) Inventors: Moon man Hur, Seoul (KR); Soon Young Eom, Daejeon (KR); Young Bae Jung, Daejeon (KR); Soon Ik Jeon, Daejeon (KR)

(73) Assignee: Electronics and Telecommunications Research Institute, Daejeon (KE)

( * ) Notice: Subject to any disclaimer, the term of this patent is extended or adjusted under 35 U.S.C. 154(b) by 338 days.

(21) Appl. No.: 12/141,714

(22) Filed: Jun. 18, 2008

(65) Prior Publication Data

US 2009/0096707 A1 Apr. 16, 2009

(30) Foreign Application Priority Data

Oct. 15, 2007 (KR) ..... 10-2007-0103459

(51) Int. Cl.
*H01Q 3/24* (2006.01)

(52) U.S. Cl. ..... 343/876; 343/700 MS; 343/853; 343/909

(58) Field of Classification Search ..... 343/700 MS, 343/750, 754, 756, 846, 848, 853, 876, 912, 343/705, 909
See application file for complete search history.

(56) References Cited

U.S. PATENT DOCUMENTS

| | | | | |
|---|---|---|---|---|
| 6,198,438 | B1 | 3/2001 | Herd et al. | |
| 7,151,506 | B2 * | 12/2006 | Knowles et al. | 343/909 |
| 7,420,524 | B2 * | 9/2008 | Werner et al. | 343/909 |
| 7,469,152 | B2 * | 12/2008 | Cetiner et al. | 455/562.1 |
| 2008/0088510 | A1 | 4/2008 | Murata et al. | |
| 2008/0132272 | A1 * | 6/2008 | Kisselev et al. | 455/552.1 |

FOREIGN PATENT DOCUMENTS

| | | | |
|---|---|---|---|
| JP | 2005-244831 | A | 9/2005 |
| JP | 2006-279493 | A | 10/2006 |
| JP | 2007-037162 | A | 2/2007 |
| KR | 2003-0014943 | A | 2/2003 |

OTHER PUBLICATIONS

Elliott Brown, "On the Gain of a Reconfigurable-Aperture Antenna" IEEE Transactions on Antennas and Propagation, vol. 49, No. 10, Oct. 2001, pp. 1357-1362.

* cited by examiner

*Primary Examiner* — Douglas W Owens
*Assistant Examiner* — Chuc D Tran
(74) *Attorney, Agent, or Firm* — Rabin & Berdo, PC

(57) ABSTRACT

A frequency reconfiguration array antenna includes a metal plate and a plurality of antenna elements. The antenna element includes a plurality of radiators and at least one switch for connecting the radiators, and a gain of at least one frequency bandwidth from among the plurality of frequency bandwidths reconfigured by the antenna elements is higher than gains of other frequency bandwidths.

17 Claims, 10 Drawing Sheets

ANTENNA ELEMENT AND FREQUENCY RECONFIGURATION ARRAY ANTENNA USING THE ANTENNA ELEMENT

CROSS-REFERENCE TO RELATED APPLICATION

This application claims priority to and the benefit of Korean Patent Application No. 10-2007-0103459 filed in the Korean Intellectual Property Office on Oct. 15, 2007, the entire contents of which are incorporated herein by reference.

BACKGROUND OF THE INVENTION (a) Field of the Invention

The present invention relates to a frequency reconfiguring antenna design technique. More particularly, the present invention relates to a technique for changing an antenna element configuring an array in order to improve array performance of a frequency reconfiguration array antenna.

This work was supported by the IT R&D program of MIC/IITA [2007-F-041-01, Intelligent Antenna Technology Development].

(b) Description of the Related Art

A reconfiguration antenna can vary antenna parameters such as frequency, polarization, and pattern by electrical or mechanical control, and a frequency reconfiguration antenna is reconfigured to be operable in at least two different frequency bandwidths. In this instance, when configuring the frequency reconfiguration antenna element (hereinafter, antenna element) as an array antenna, the array interval is fixed with reference to a single frequency, in general, the center frequency of the intermediate bandwidth in the entire reconfiguration bandwidth.

In this instance, array performance of the frequency reconfiguration array antenna is determined by a radiation pattern that is expressed in Equation 1.

$$P_{total}(\omega)=P_{element}(\omega)\times AF(\omega) \quad \text{(Equation 1)}$$

Here, $P_{total}(w)$ is a radiation pattern of the entire array antenna, $P_{element}(w)$ is a radiation pattern of the antenna element which is a single element, and AF(w) is an array factor. The array factor is determined by a physical gap between antenna elements, intensity ratio of signals supplied to the respective antenna elements, and phase difference. The radiation pattern and the array factor of the antenna element are variable by the frequency, and hence the radiation pattern of the entire frequency reconfiguration array antenna is also variable by the frequency.

The array performance of the frequency reconfiguration array antenna is determined by an array gain determined by the radiation pattern, a beam width, a size of a side lobe, and beam efficiency of the radiation pattern.

In this instance, since the frequency reconfiguration antenna element has a different area of a radiator according to the frequency bandwidth, it has a relatively uniform gain in the reconfigured frequency bandwidth, differing from the wideband or multiband antenna. When the antenna element having a constant gain reconfigures the frequency bandwidth by using a high frequency bandwidth, the beam efficiency is reduced because of the increase of the side lobe, and hence the array performance in the high frequency bandwidth can be reduced.

The above information disclosed in this Background section is only for enhancement of understanding of the background of the invention and therefore it may contain information that does not form the prior art that is already known in this country to a person of ordinary skill in the art.

SUMMARY OF THE INVENTION

The present invention has been made in an effort to provide a changed antenna element for improving array performance in the high frequency bandwidth from among the entire reconfigured bandwidth of a frequency reconfiguration array antenna.

In one aspect of the present invention, in a frequency reconfiguration array antenna, an array antenna includes a first metal plate and a plurality of antenna elements arranged on the first metal plate with an array distance, the antenna elements each include a plurality of radiators and at least one switch for connecting between the plurality of radiators, and a gain of at least one of a plurality of frequency bandwidths reconfigured by the antenna elements is higher than gains in other frequency bandwidths.

In another aspect of the present invention, in a frequency reconfiguration array antenna, an array antenna includes a metal plate and a plurality of antenna elements formed on the metal plate to form an array antenna and arranged according to an array distance, wherein each antenna element includes: a first radiator; a second radiator surrounding the first radiator; a third radiator surrounding the second radiator; a first switch for connecting the first radiator and the second radiator; and a second switch for connecting the second radiator and the third radiator, and a plurality of frequency bandwidths are configured by the first, second, and third radiators according to the on/off operation by the first and second switch elements, and a gain of at least one of the plurality of frequency bandwidths is higher than gains of other frequency bandwidths.

In another aspect of the present invention, in an antenna element arranged to a frequency reconfiguration array antenna, an antenna element includes: a plurality of radiators; and at least one switch for connecting between the plurality of radiators, and the plurality of frequency bandwidths are formed by the plurality of radiators according to the on/off operation by the at least one switch, and a gain of at least one of the plurality of frequency bandwidths is higher than gains of other frequency bandwidths.

According to the exemplary embodiment of the present invention, the antenna element dispose to the frequency reconfiguration array antenna can be changed to have a high gain in the high frequency bandwidth, and array performance in the high frequency bandwidth can be improved by using the changed antenna element.

DETAILED DESCRIPTION OF THE EMBODIMENTS

Figure 1:
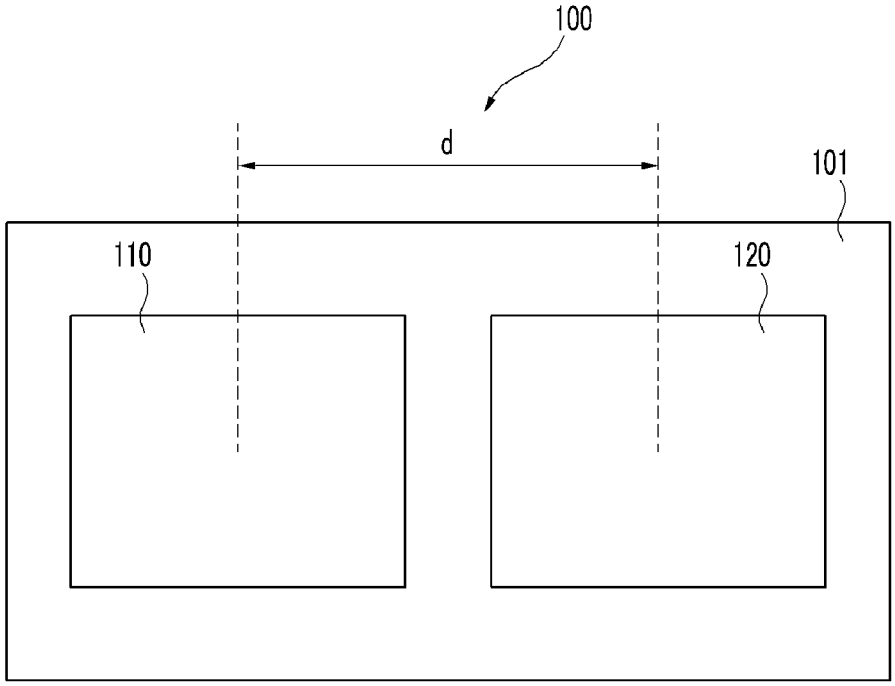
FIG. 1 is a frequency reconfiguration array antenna according to an exemplary embodiment of the present invention.

In the following detailed description, only certain exemplary embodiments of the present invention have been shown and described, simply by way of illustration. As those skilled in the art would realize, the described embodiments may be modified in various different ways, all without departing from the spirit or scope of the present invention. Accordingly, the drawings and description are to be regarded as illustrative in nature and not restrictive. Like reference numerals designate like elements throughout the specification.

Throughout this specification and the claims which follow, unless explicitly described to the contrary, the word "comprising" and variations such as "comprises" will be understood to imply the inclusion of stated elements but not the exclusion of any other elements.

A configuration of a frequency reconfiguration array antenna according to an exemplary embodiment of the present invention will now be described.

Figure 2:
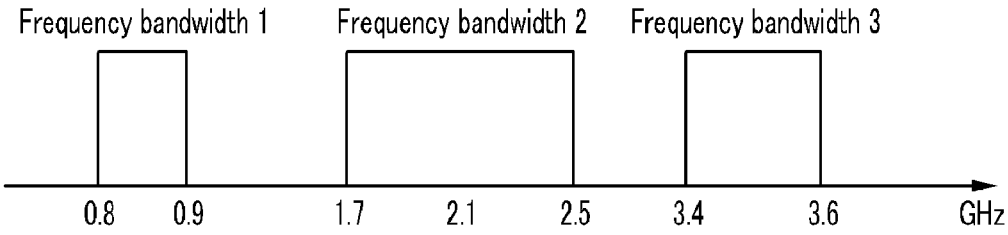
FIG. 2 is a frequency bandwidth reconfigured in a frequency reconfiguration array antenna according to an exemplary embodiment of the present invention.
Figure 3:
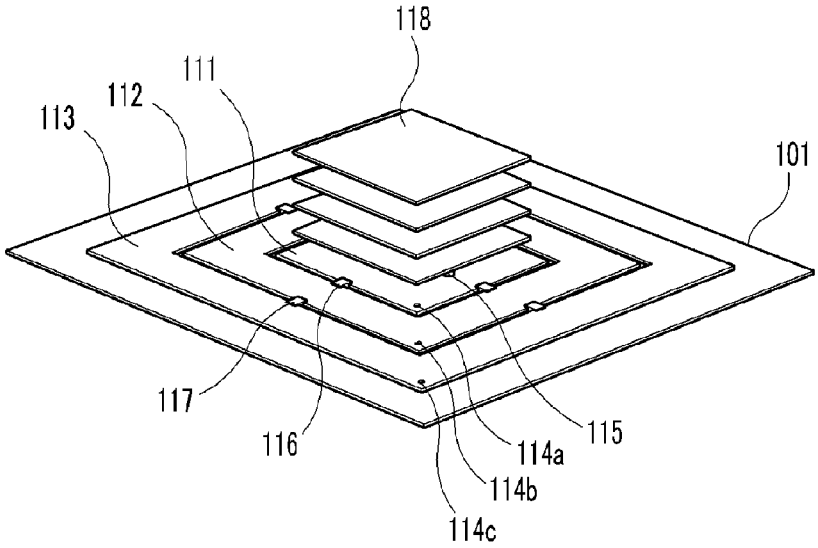
FIG. 3 is a perspective view of a frequency reconfiguration antenna element according to an exemplary embodiment of the present invention.
Figure 4:
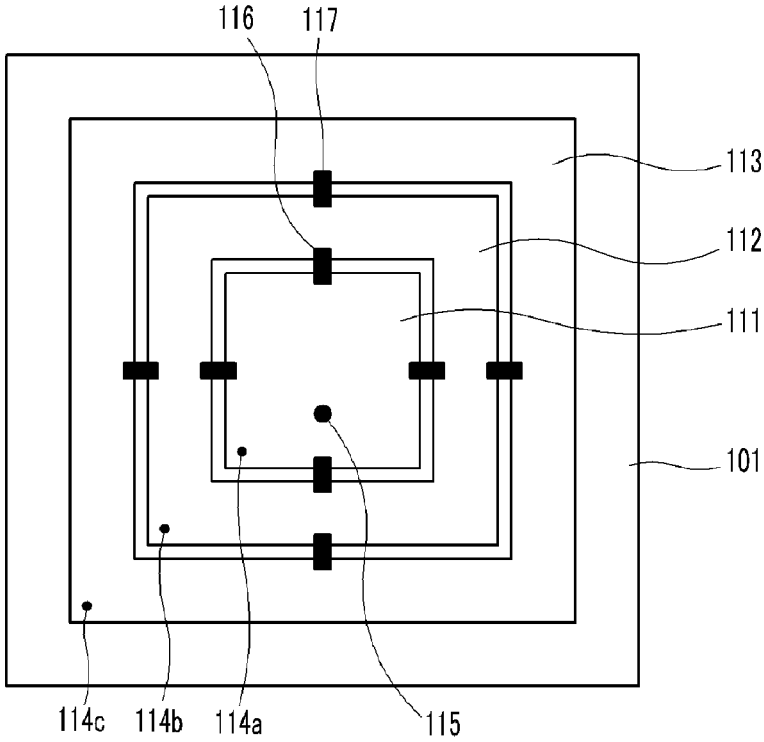
FIG. 4 is a top plan view of an antenna element of FIG. 3.

FIG. 1 is a frequency reconfiguration array antenna according to an exemplary embodiment of the present invention. FIG. 2 is a frequency bandwidth reconfigured in a frequency reconfiguration array antenna according to an exemplary embodiment of the present invention. FIG. 3 is a perspective view of a frequency reconfiguration antenna element according to an exemplary embodiment of the present invention, and FIG. 4 is a top plan view of an antenna element of FIG. 3.

As shown in FIG. 1, the frequency reconfiguration array antenna 100 includes a metal plate 101 and antenna elements 110 and 120.

The antenna elements 110 and 120 are arranged on the metal plate 101 according to the array distance (d). Here, the metal plate 101 is formed to be a plane and functions as a reflector of the antenna elements 110 and 120, and the array distance (d) is determined by the center frequency of the frequency bandwidth for the antenna elements 110 and 120 to acquire the highest array gain, and it represents the distance between the two antenna elements 110 and 120. In this instance, when 2N antenna elements are formed on the metal plate 101, the frequency reconfiguration array antenna has (N×2)-array antenna elements according to the metal plate 101. For ease of description, a (1×2)-array frequency reconfiguration array antenna in which antenna elements 110 and 120 are formed on the metal plate 101 will be exemplified to be described in FIG. 1.

As shown in FIG. 2, the antenna elements 110 and 120 of the frequency reconfiguration array antenna 100 are assumed to reconfigure the first frequency bandwidth (0.8-0.9 GHz), the second frequency bandwidth (1.7-2.5 GHz), and the third frequency bandwidth (3.4-3.6 GHz). In this instance, the array distance (d) of the antenna elements 110 and 120 is set to be 10.7 cm that corresponds to 0.75λ of the center frequency 2.1 GHz of the second frequency bandwidth (1.7-2.5 GHz) so that the antenna elements may have the highest array gain.

Referring to FIG. 3 and FIG. 4, the antenna elements 110 and 120 include radiators 111, 112, and 113, DC power sources 114*a*, 114*b*, and 114*c*, a radio frequency (RF) power source 115, switches 116 and 117, and a parasitic element 118.

The radiator 111, 112, and 113 are separately arranged on the metal plate 101, and in detail, the radiator 112 is formed to surround the quadrangular radiator 111, and the radiator 113 is formed to surround the radiator 112. The radiators 111 and 112 are connected to the switch 116, and the radiators 112 and 113 are connected to the switch 117. Here, the switches 116 and 117 can be PIN diodes, transistors, or micro-electromechanical systems (MEMS). The switches 116 and 117 are illustrated as four switches formed on the centers of the four sides of the quadrangle in FIG. 3 and FIG. 4, and further, the number of the switches 116 and 117 is variable.

As shown in FIG. 3, a parasitic element 118 is accumulated on the radiator 111 in the vertical direction. In this instance, the accumulated parasitic element 118 is illustrated to be a quadrangular metal plate, and it can be a circular or oval metal plate without being restricted thereto in the embodiment of the present invention. In the exemplary embodiment of the present invention, four metal plates are accumulated to form a parasitic element, and the number of accumulated metal plates is not restricted thereto.

Referring to FIG. 2 and FIG. 3, regarding the antenna elements 110 and 120, when the switches 116 and 117 are turned on, the radiators 111, 112, and 113 are connected to configure a first frequency bandwidth (0.8-0.9 GHz). When the switch 116 is turned on and the switch 117 is turned off, the radiators 111 and 112 are connected to configure a second frequency bandwidth (1.7-2.5 GHz). Also, when the switches 116 and 117 are turned off, the antenna elements 110 and 120 configure a third frequency bandwidth (3.4-3.6 GHz) according to the operation by the radiator 111.

In the exemplary embodiment of the present invention, the antenna element for increasing the gain in the high frequency bandwidth uses the structure for vertically accumulating the parasitic element on the radiator, and without being restricted to this, the antenna can be designed to have a high gain in the high frequency bandwidth by using the antenna structure shown in FIG. 5A to FIG. 5E.

An antenna element designed in various manners to have a high gain in the high frequency bandwidth according to an exemplary embodiment of the present invention will now be described with reference to FIG. 5A to FIG. 5E.

Figure 5A:
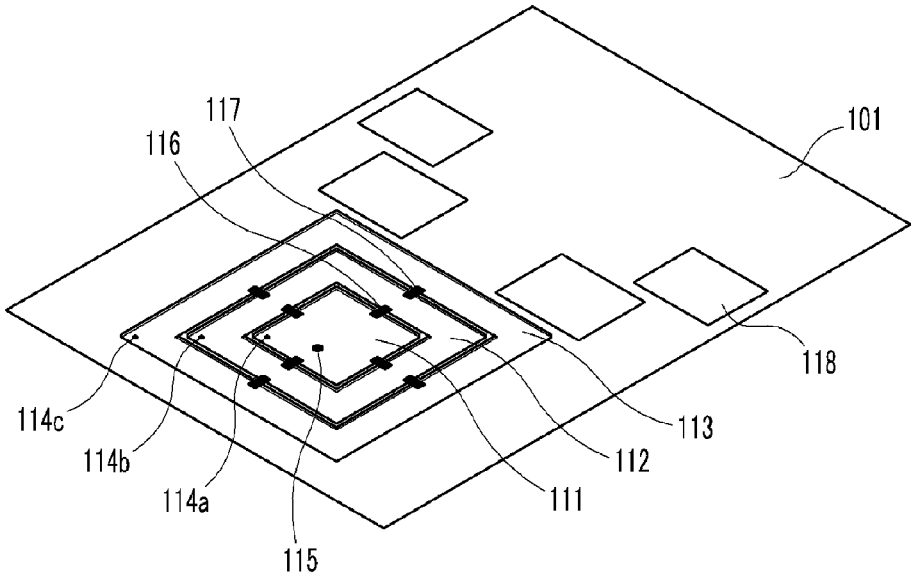
FIG. 5A to FIG. 5E are perspective views of a frequency reconfiguration antenna element according to an exemplary embodiment of the present invention.

The antenna element shown in FIG. 5A includes radiators 111, 112, and 113, DC power sources 114*a*, 114*b*, and 114*c*, a radio frequency power source 115, switches 116 and 117, and a parasitic element 118.

The arrangement of the radiators 111, 112, and 113, the DC power sources 114*a*, 114*b*, and 114*c*, the radio frequency power source 115, and the switches 116 and 117 on the metal plate 101 corresponds to the case of the antenna element shown in FIG. 3, and the antenna element shown in FIG. 5A arranges the parasitic element 118 on the plane of the metal plate 101 on which the radiators 111, 112, and 113 are arranged to thus gather the beams of high frequency bandwidths and have a high gain in the high frequency bandwidth. In this instance, the form and arrangement of the parasitic element 118 are designed to gather the beams of the high frequency bandwidth.

Figure 5B:
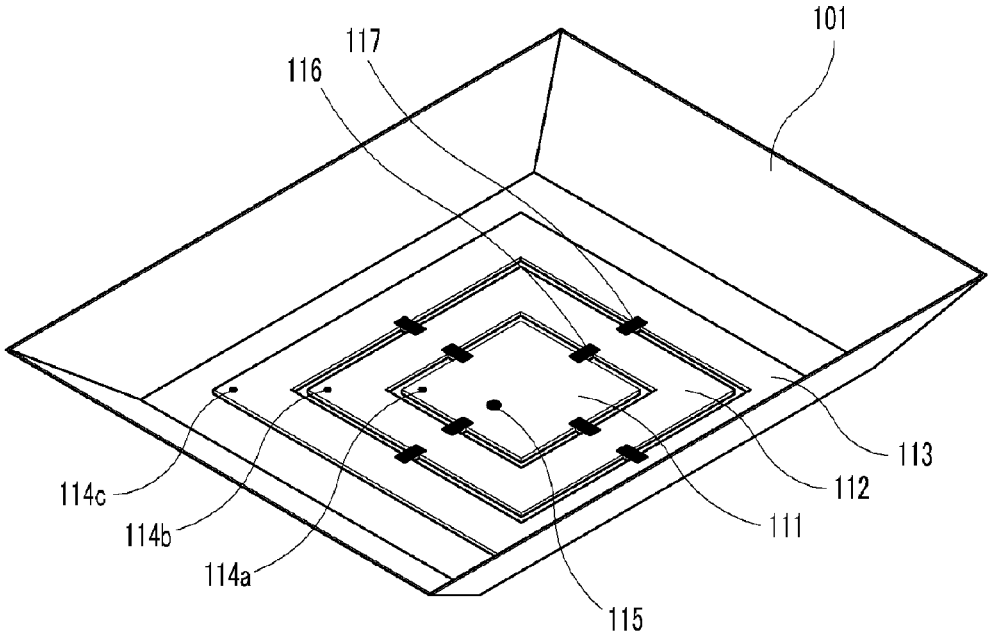

The antenna element shown in FIG. 5B includes radiators 111, 112, and 113, DC power sources 114*a*, 114*b*, and 114*c*, a radio frequency power source 115, and switches 116 and 117.

The arrangement of the radiators 111, 112, and 113, the DC power sources 114*a*, 114*b*, and 114*c*, the radio frequency power source 115, and the switches 116 and 117 on the metal plate 101 corresponds to the case of the antenna element shown in FIG. 3, and the antenna element shown in FIG. 5B changes the form of the metal plate 101 so as to gather the beams of the high frequency bandwidth. The form-changed structure of the metal plate 101 in a like manner of the antenna element shown in FIG. 5B is referred to as a surface mounted horn structure, and it increases the gain of the high frequency bandwidth by gathering the beams according to the same principle as the horn antenna.

Figure 5C:
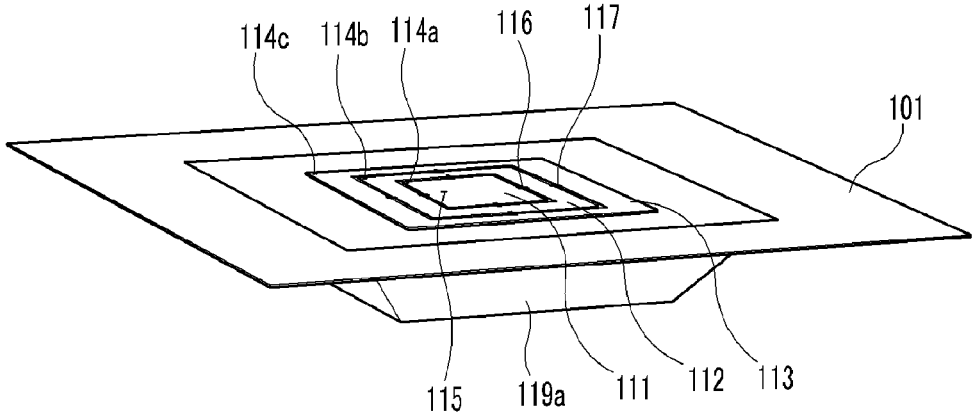

The antenna element shown in FIG. 5C includes radiators 111, 112, and 113, DC power sources 114*a*, 114*b*, and 114*c*, a radio frequency power source 115, switches 116 and 117, and a resonator 119*a*.

The arrangement of the radiators 111, 112, and 113, the DC power sources 114*a*, 114*b*, and 114*c*, the radio frequency power source 115, and the switches 116 and 117 on the metal plate 101 corresponds to the case of the antenna element shown in FIG. 3, and the antenna element shown in FIG. 5C arranges the resonator 119*a* on the lower part of the radiators 111, 112, and 113 to gather the beams of the high frequency bandwidth and acquire a high gain in the high frequency bandwidth. In this instance, the resonator 119*a* is filled with dielectric material with great dielectric constant.

Figure 5D:
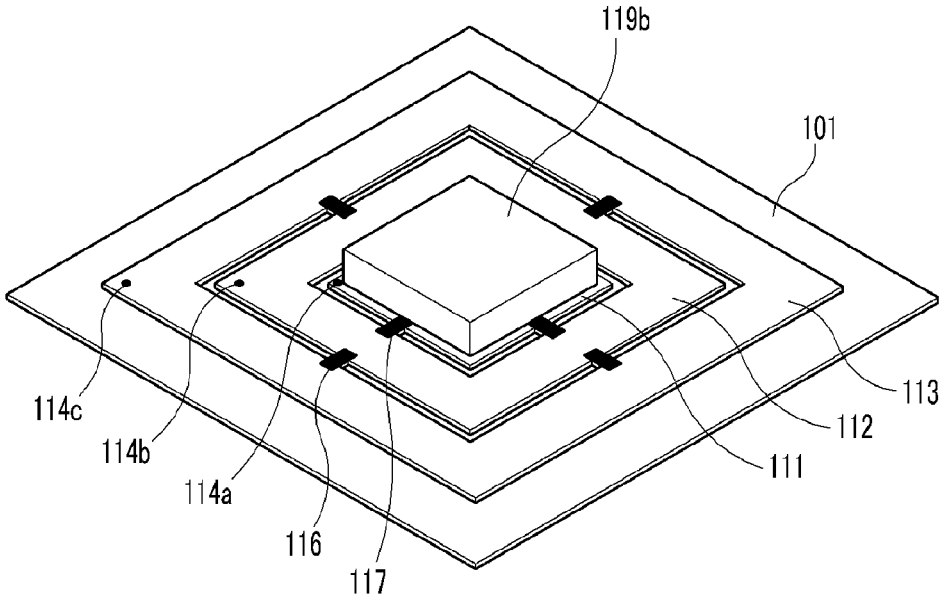

The antenna element shown in FIG. 5D includes radiators 111, 112, and 113, DC power sources 114*a*, 114*b*, and 114*c*, a radio frequency power source (not shown), switches 116 and 117, and dielectric material 119*b*.

The arrangement of the radiators 111, 112, and 113, the DC power sources 114*a*, 114*b*, and 114*c*, the radio frequency power source (not shown), and the switches 116 and 117 on the metal plate 101 corresponds to the case of the antenna element shown in FIG. 3, and the antenna element shown in FIG. 5D arranges the dielectric material 119*a* on the radiators 111, 112, and 113 to thus gather the beams of the high frequency bandwidth and acquire a high gain in the high frequency bandwidth. In this instance, the dielectric constant and form of the dielectric material 119*b* are designed to gather the beams of the high frequency bandwidth.

Figure 5E:
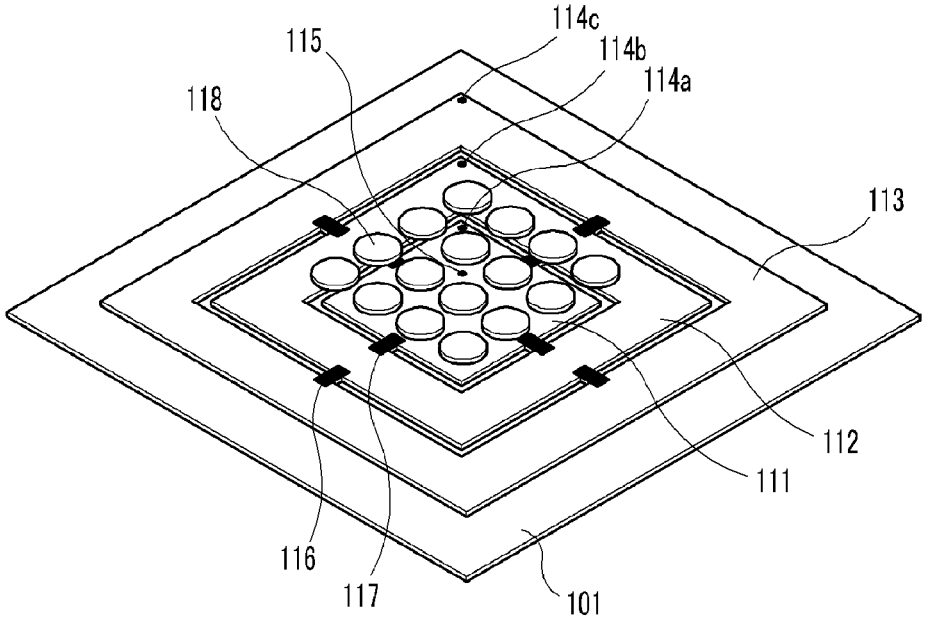

The antenna element shown in FIG. 5E includes radiators 111, 112, and 113, DC power sources 114*a*, 114*b*, and 114*c*, a radio frequency power source 115, switches 116 and 117, and a parasitic element 118.

The arrangement of the radiators 111, 112, and 113, the DC power sources 114*a*, 114*b*, and 114*c*, the radio frequency power source 115, and the switches 116 and 117 on the metal plate 101 corresponds to the case of the antenna element shown in FIG. 3, and the antenna element shown in FIG. 5E is formed as a circle on the radiators 111, 112, and 113, and periodically arranges the metallic parasitic element 118 to thus gather the beams of the high frequency bandwidth and acquire a high gain in the high frequency bandwidth.

The antenna element according to the exemplary embodiment of the present invention can be designed into various structures so as to have a high gain in the high frequency bandwidth, and is not restricted to the structure of the antenna element shown in FIG. 3 to FIG. 5E.

Array performance according to the size of a side lobe will now be described with reference to FIG. 6 to FIG. 8.

Figure 6:
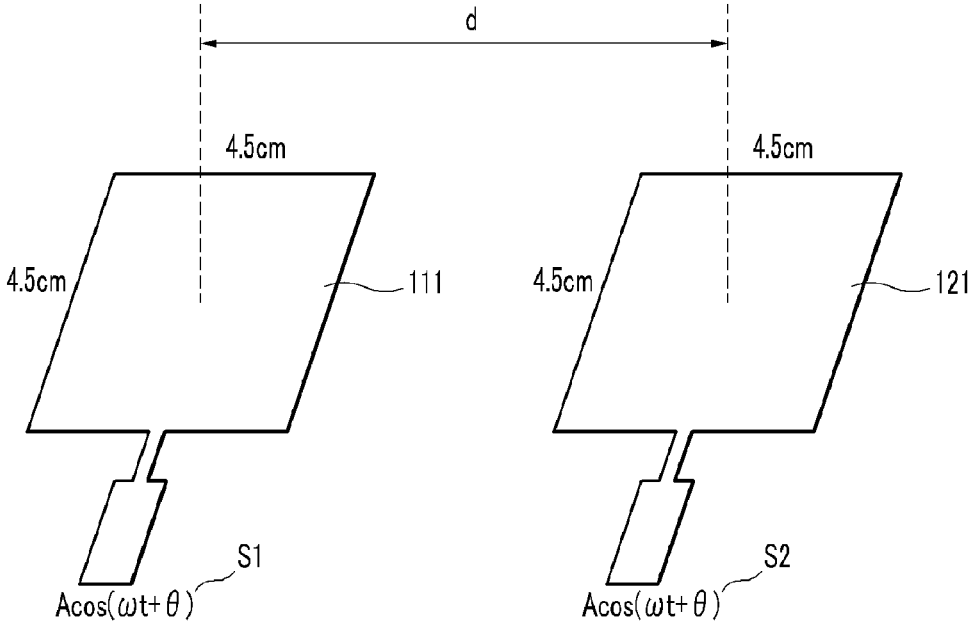
FIG. 6 is a (1×2)-array patch antenna.
Figure 7:
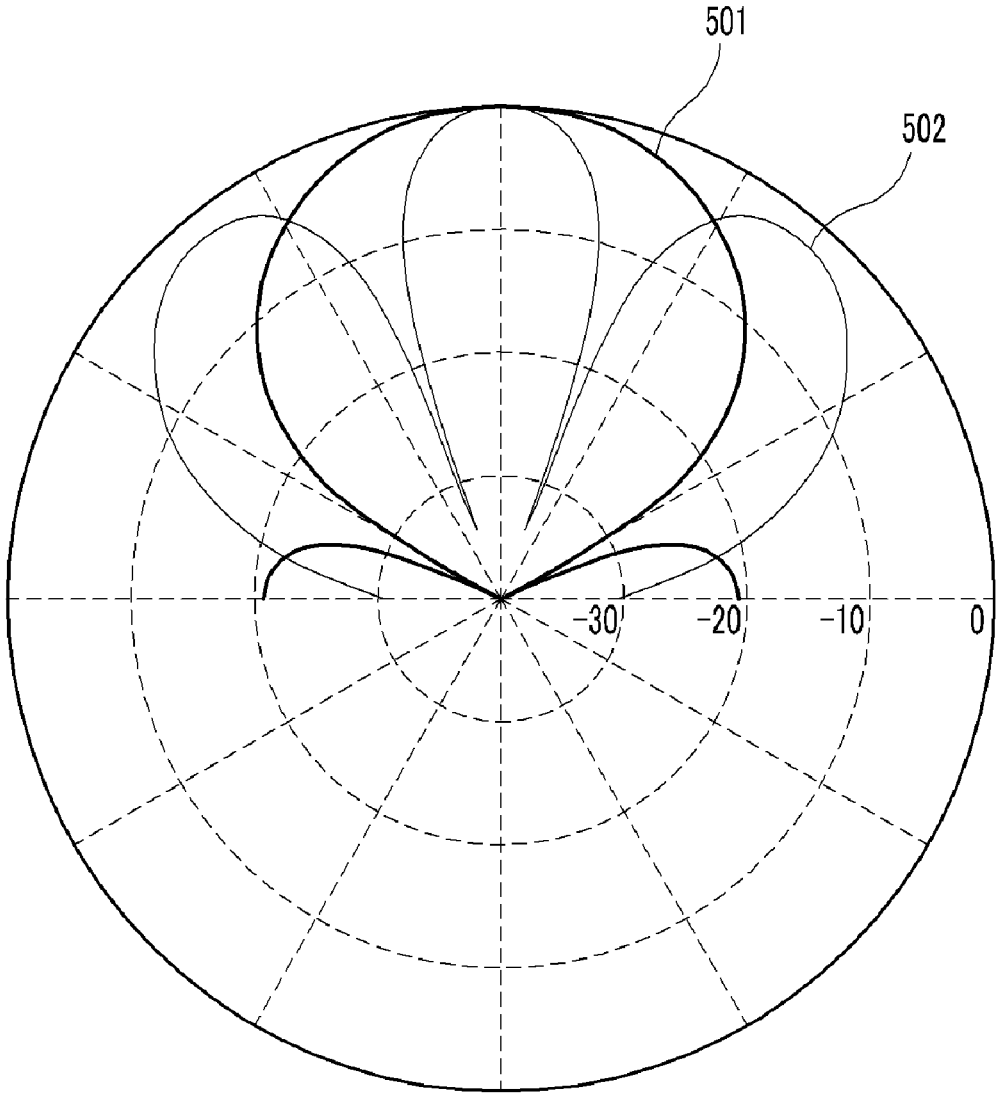
FIG. 7 is a radiation pattern of a (1×2)-array patch antenna.

FIG. 6 is a (1×2)-array patch antenna, and FIG. 7 is a radiation pattern of a (1×2)-array patch antenna. FIG. 8 is array performance according to the size of a side lobe using a radiation pattern shown in FIG. 7.

In order to check array performance depending on the size of the side lobe, patch antennas 111 and 121 having the operational frequency of 2.2 GHz and the width and the height of 4.5 cm are arranged as (1×2) as shown in FIG. 6. In this instance, the amplitude (A) and the phase (θ) of the signals S1 and S2 supplied to the patch antennas 111 and 121 are set to be the same as each other. The radiation pattern of the array antenna is found as shown in FIG. 7 by changing the array distance (d) between the antenna elements to 7.6 cm and 20.2 cm.

As shown in FIG. 7, when the radiation pattern 501 when the array distance (d) is set to be 7.6 cm and the radiation pattern 502 when the array distance (d) is set to be 20.2 cm are compared, the gains of the two radiation patterns are both 10.2 dBi. However, the radiation pattern 501 when the array distance (d) is 7.6 cm has a beam width of 46° and a side lobe of −21 dB, and the radiation pattern 502 when the array distance (d) is 20.2 cm has a beam width of 19° and a side lobe of −2 dB, so that the case of setting the array distance (d) as 7.6 cm and the case of setting the array distance (d) as 20.2 cm have different array characteristics. That is, the gains of the two radiation patterns are the same, and the radiation pattern 502 when the array distance (d) is set to be 20.2 cm radiates the energy of −2 dB (63.1%) in the direction of the side lobe compared to the main lobe, and hence efficiency of the antenna is reduced. On the contrary, the radiation pattern 501 when the array distance (d) is set to be 7.6 cm radiates energy of −21 dB (0.8%) in the direction of the side lobe compared to the main lobe, and hence antenna efficiency is increased as much as that.

Here, the antenna efficiency is determined by factors including beam efficiency of the radiation pattern, an impedance matching degree of an input terminal, loss by material, and a reflection loss of the Radome or an outer case. However, since the matching degree, material loss, and reflection loss are constant in the frequency reconfiguration array antenna, array performance of the array antenna is determined by the beam efficiency of the radiation pattern, and the equation for the beam efficiency is expressed in Equation 2.

$$\varepsilon_M = \frac{\Omega_M}{\Omega_A} \times 100(\%) \qquad \text{(Equation 2)}$$

Here, $\Omega_M$, is the beam area of the main beam, and $\Omega_A$ is the entire beam area of the radiation pattern calculated in Equation 3.

$$\Omega_A = \int_{\phi=0}^{\phi=2\pi} \int_{\theta=0}^{\theta=\pi} P_n(\theta, \phi) \sin\theta \, d\theta \, d\phi \qquad \text{(Equation 3)}$$

Here, $P_n(\theta, \phi)$ is the radiation pattern having the maximum value normalized as 1.

When the beam efficiency is calculated using Equation 2 and Equation 3, the beam efficiency of the radiation pattern 501 when the array distance (d) is set to be 7.6 cm is 99.92%, and the beam efficiency of the radiation pattern 502 when the array distance (d) is set to be 20.2 cm is 45.80%. That is, the radiation pattern 501 when the array distance (d) is set to be 7.6 cm generates better array performance.

Figure 8:
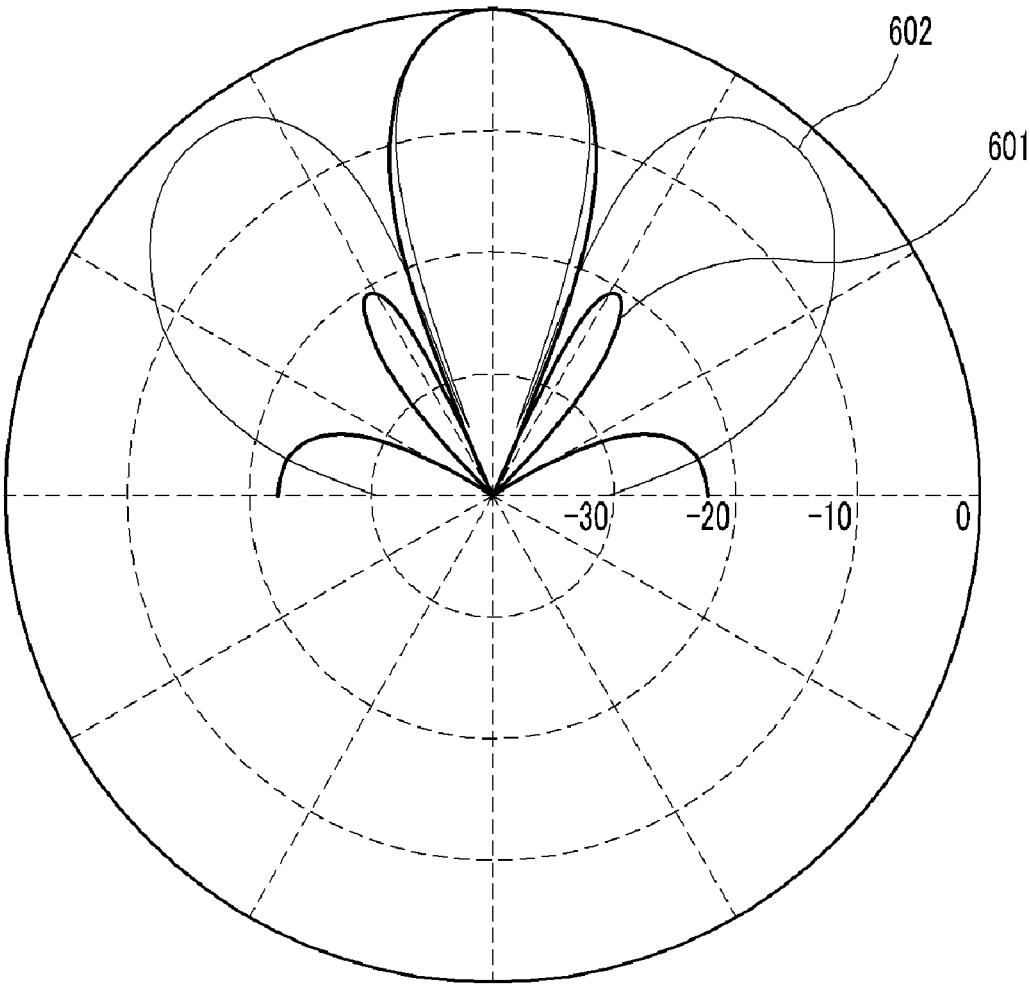
FIG. 8 is array performance according to the size of side lobe using a radiation pattern shown in FIG. 7.

In this instance, as shown in FIG. 8, the beam width of the radiation pattern 502 when the array distance (d) is set to be 20.2 cm is maintained at 19° and the size of the side lobe is reduced to be −21 dB which is the size of the side lobe of the radiation pattern 501 when the array distance (d) is set to be 7.6 cm, so the beam efficiency of the radiation pattern 503 when the array distance (d) is set to be 20.2 cm is increased to be 99.03%. Here, since the beam width of the main beam is constant, the increased beam efficiency increases the antenna gain, and the gain of the antenna when the array distance (d) is set to be 20.2 cm is increased from 10.2 dBi to 15.0 dBi.

Accordingly, it is needed to concurrently consider the gain of the antenna and the size of the side lobe for array performance since the beam efficiency of the radiation pattern having the same gain can be increased according to the size of the side lobe.

Array performance of a frequency reconfiguration array antenna according to an exemplary embodiment of the present invention will now be described with reference to FIG. 9 to FIG. 11.

In order to compare with the frequency reconfiguration array antenna according to an exemplary embodiment of the present invention, it is assumed that the antenna element in which no parasitic element is accumulated on the radiator in FIG. 3 (hereinafter, a "general frequency reconfiguration array antenna element") is a (1×2) array arranged frequency reconfiguration array antenna (hereinafter, a "general frequency reconfiguration array antenna"). The array distance between the antenna elements of the general frequency reconfiguration array antenna and the frequency reconfiguration array antenna according to the exemplary embodiment of the present invention is set to be 10.7 cm that corresponds to 0.75λ of the center frequency 2.1 GHz of the second frequency bandwidth (1.7 to 2.5 GHz) so that the antenna elements may acquire the highest array gain.

Figure 9:
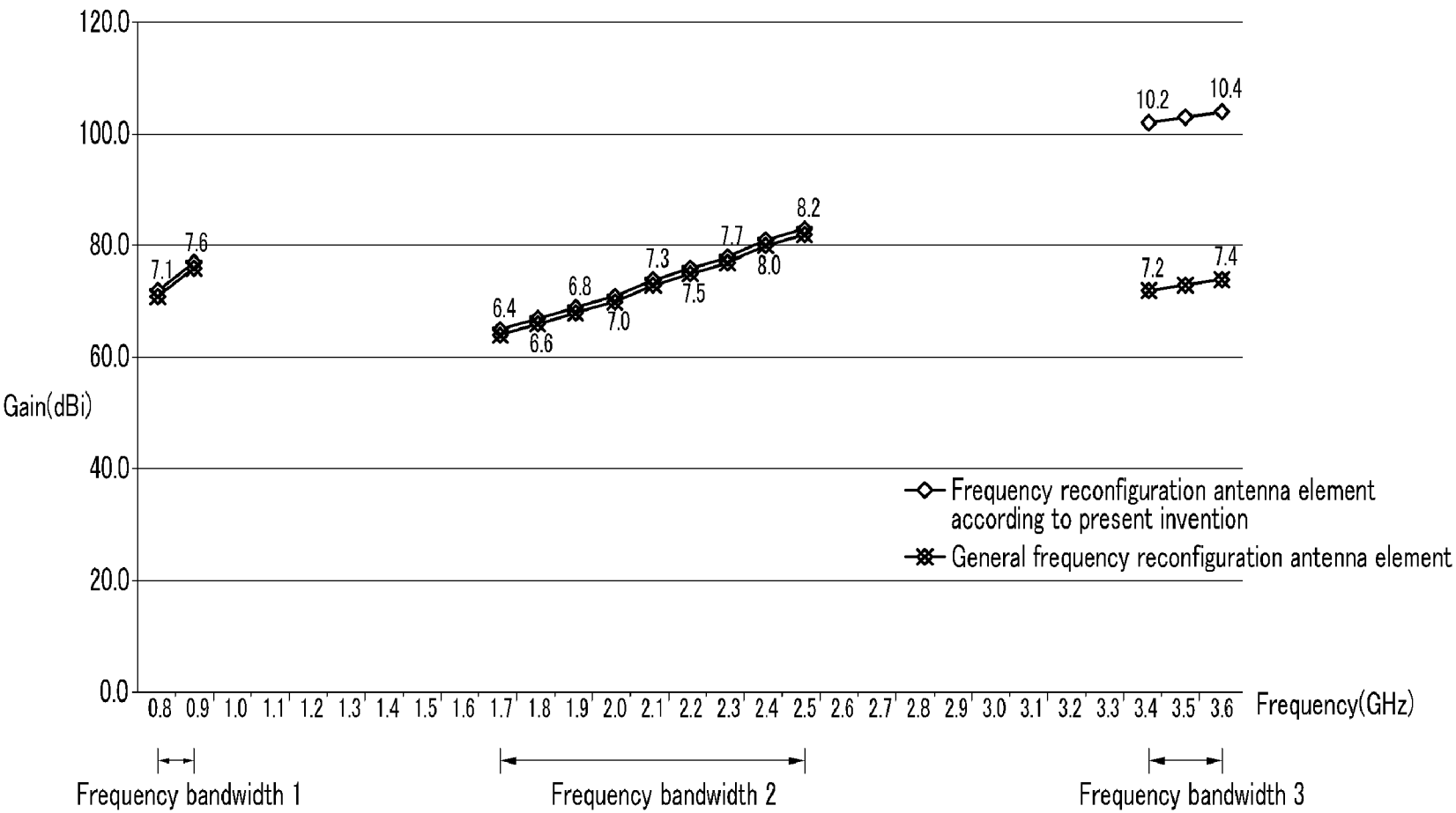
FIG. 9 is gains of a frequency reconfiguration antenna element according to an exemplary embodiment of the present invention and a general frequency reconfiguration antenna element.

FIG. 9 shows gains of a frequency reconfiguration antenna element according to an exemplary embodiment of the present invention and a general frequency reconfiguration antenna element. FIG. 10 is a graph showing array performance of a general frequency reconfiguration array antenna. FIG. 11 is a graph showing array performance of a frequency reconfiguration array antenna according to an exemplary embodiment of the present invention.

As shown in FIG. 9, the gain of the first frequency bandwidth (0.8 to 0.9 GHz) of the general frequency reconfiguration antenna element is 7.1 to 7.6 dBi, the gain of the second frequency bandwidth (1.7 to 2.5 GHz) is 6.4 to 8.2 dBi, and the gain of the third frequency bandwidth (3.4 to 3.6 GHz) is 7.2-7.4 dBi.

Figure 10:
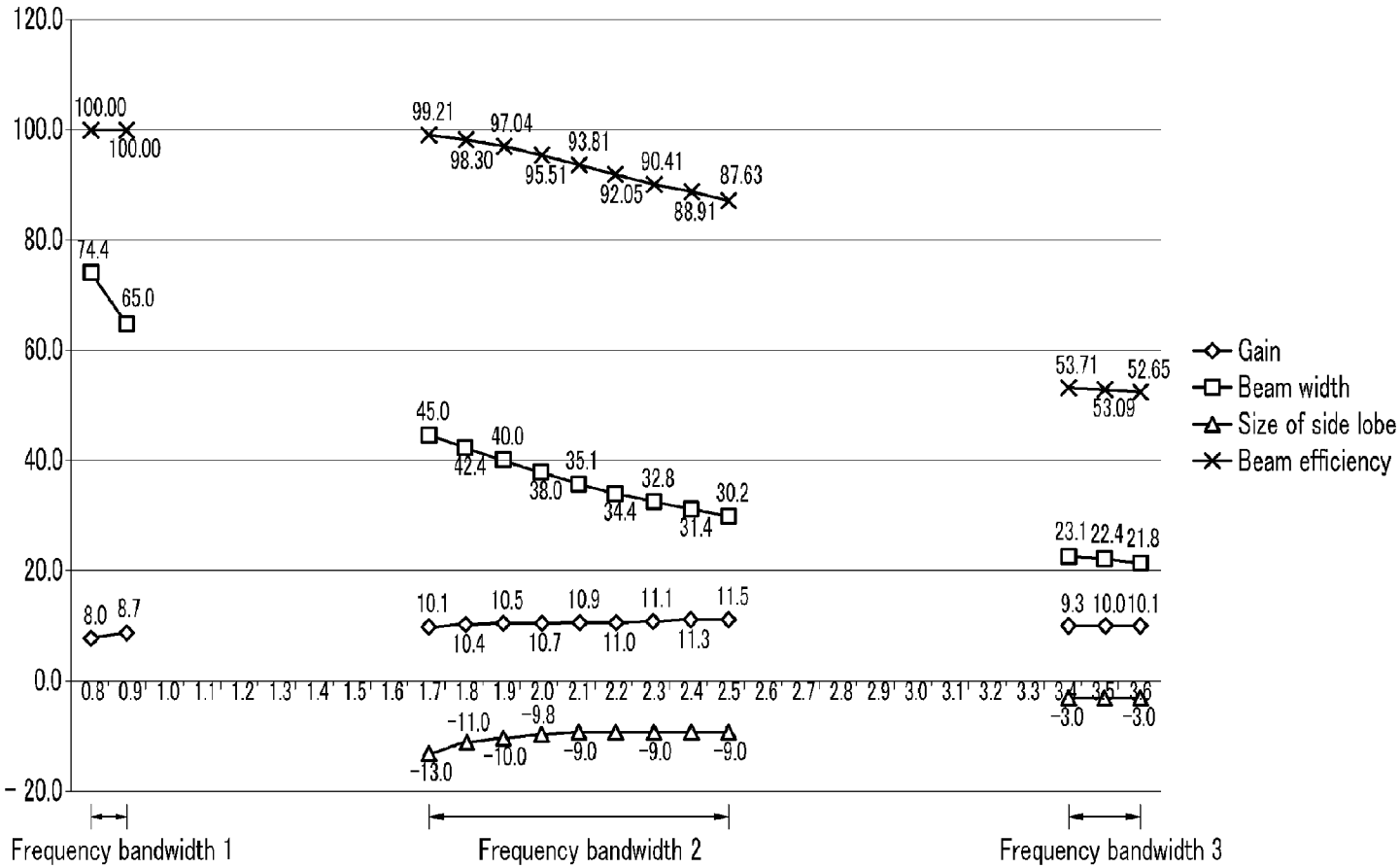
FIG. 10 is a graph showing array performance of a general frequency reconfiguration array antenna.

As shown in FIG. 10, the beam width of the first frequency bandwidth (0.8 to 0.9 GHz) of the general frequency reconfiguration array antenna is 65 to 74.4°, the beam efficiency is 100% since there is no side lobe, and the gain is 8.0 to 8.7 dBi, according to the gains of the frequency bandwidths shown in FIG. 9.

The beam width of the second frequency bandwidth (1.7 to 2.5 GHz) is 30.2 to 45.0°, the side lobe is −13.0 to −9.0 dB, and the gain is 10.1 to 11.5 dBi. As the frequency is increased in the second frequency bandwidth (1.7 to 2.5 GHz), the beam width is reduced to increase the gain, and simultaneously the size of the side lobe is increased so that the beam efficiency is reduced from 99.21% to 87.63%.

Since the beam width of the third frequency bandwidth (3.4 to 3.6 GHz) is 21.8 to 23.1° and the side lobe is −3.0 dB, the beam efficiency becomes 52.65% to 53.71% and the gain is 9.6 to 10.1 dBi.

The frequency of 1.7 GHz from among the second frequency bandwidth (1.7 to 2.5 GHz) of the general frequency reconfiguration array antenna has the gain of 10.1 dBi and the beam efficiency of 99.21%. The frequency of 3.6 GHz from among the third frequency bandwidth (3.4 to 3.6 GHz) has the gain of 10.1 dBi and the beam efficiency of 52.65%. In this instance, when other conditions are given identically, the beam efficiency (52.65%) at the frequency of 3.6 GHz when the same power is input has about ½ beam efficiency of the beam efficiency (99.21%) at the frequency of 1.7 GHz, and hence half of the power radiated at the frequency of 1.7 GHz is radiated in the air at the frequency of 3.6 GHz. That is, the general frequency reconfiguration array antenna generates the optimal array performance in the low frequency bandwidths such as the first and the second frequency bandwidth (0.8 to 0.9 GHz, 1.7 to 2.5 GHz), and degrades the array performance in the high frequency bandwidth such as the third frequency bandwidth (3.4 to 3.6 GHz).

As shown in FIG. 9, in the frequency reconfiguration antenna element formed as shown in FIG. 3 according to the exemplary embodiment of the present invention, the gain of the first frequency bandwidth (0.8 to 0.9 GHz) is 7.1 to 7.6 dBi, the gain of the second frequency bandwidth (1.7 to 2.5 GHz) is 6.4 to 8.2 dBi, and the gain of the third frequency bandwidth (3.4 to 3.6 GHz) is 10.2 to 10.4 dBi. Hence, the frequency reconfiguration antenna element according to the exemplary embodiment of the present invention has a high gain in the third frequency bandwidth (3.4 to 3.6 GHz), differing from the general frequency reconfiguration antenna element. That is, regarding the frequency reconfiguration antenna element according to the exemplary embodiment of the present invention, the parasitic element formed on the radiator forming the high frequency bandwidth (the third frequency bandwidth) is resonated in the high frequency bandwidth to thus acquire a high gain in the high frequency bandwidth.

Figure 11:
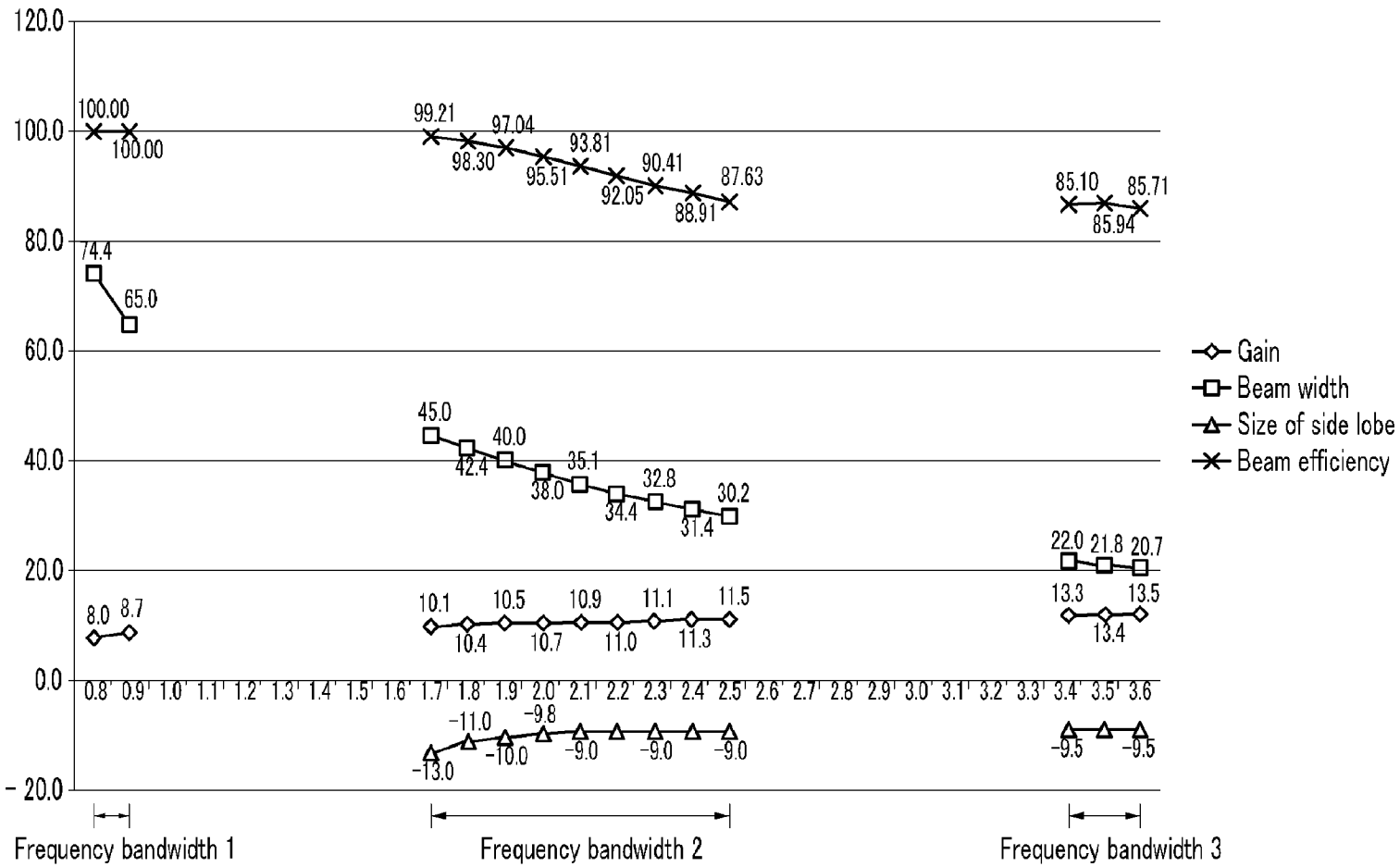
FIG. 11 is a graph showing array performance of a frequency reconfiguration array antenna according to an exemplary embodiment of the present invention.

As shown in FIG. 11, the frequency reconfiguration array antenna according to the exemplary embodiment of the present invention has the beam width of 65-74.4° in the first frequency bandwidth (0.8 to 0.9 GHz), has no side lobe, and has the gain of 8.0 to 8.7 dBi depending on the gain of the frequency bandwidth, and hence the beam efficiency becomes 100%.

The beam width in the second frequency bandwidth (1.7 to 2.5 GHz) is 30.2 to 45.0°, the side lobe is −13.0 to −9.0 dB, and the gain is 10.1 to 11.5 dBi. As the frequency is increased in the second frequency bandwidth (1.7 to 2.5 GHz), the beam width is reduced to increase the gain and simultaneously increase the size of the side lobe, thereby reducing the beam efficiency from 99.21% to 87.63%.

The beam width in the third frequency bandwidth (3.4 to 3.6 GHz) is 20.7 to 22.0°, the side lobe is −9.50 dB, and the gain is 13.3 to 13.5 dBi, and hence the beam efficiency is 85.10 to 85.94%.

The frequency reconfiguration array antenna according to the exemplary embodiment of the present invention has the same gain and beam efficiency of the first frequency bandwidth (0.8 to 0.9 GHz) and the second frequency bandwidth (1.7 to 2.5 GHz) as the general frequency reconfiguration array antenna, thereby generating the same array performance. That is, the array performance in the frequency bandwidths such as the first and second frequency bandwidths are the same for the frequency reconfiguration array antenna according to the exemplary embodiment of the present invention and the general frequency reconfiguration array antenna.

However, the frequency reconfiguration array antenna according to the exemplary embodiment of the present invention increases the gain by 3 dB in the high frequency bandwidth such as the third frequency bandwidth (3.4 to 3.6 GHz) by using the antenna element designed to have a high gain in the high frequency, compared to the general frequency reconfiguration array antenna. Therefore, the size of the side lobe is reduced from −3.0 dB to −9.5 dB, and the beam efficiency is increased (by about 33%) to thereby improve the array performance of the high frequency bandwidth.

Since the frequency reconfiguration array antenna according to the exemplary embodiment of the present invention uses the antenna element that is designed to have a high gain in the high frequency bandwidth, the radiation pattern of the antenna element can be changed, and the array performance in the high frequency bandwidth such as the third frequency bandwidth (3.4-3.6 GHz) can be improved.

In the exemplary embodiment of the present invention, the antenna element having a structure for accumulating the parasitic element on the radiator has been described so as to increase the gain in the high frequency bandwidth, and the present invention is not restricted thereto, and another structure for increasing the gain in the high frequency bandwidth can also be used.

The above-described embodiments can be realized through a program for realizing functions corresponding to the configuration of the embodiments or a recording medium for recording the program in addition to through the above-described device and/or method, which is easily realized by a person skilled in the art.

While this invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims.

What is claimed is:

1. In a frequency reconfiguration array antenna, an array antenna comprising:

a first metal plate, and a plurality of antenna elements arranged on the first metal plate according to an array distance, wherein each antenna element comprises a plurality of radiators, a parasitic element and at least one switch for connecting between the radiators, a gain of at least one of a plurality of frequency bandwidths reconfigured by the antenna elements is higher than gains of others of the frequency bandwidths, and the parasitic element of each antenna element is configured to increase a gain of the at least one of the plurality of frequency bandwidths.

2. The array antenna of claim 1, wherein the at least one frequency bandwidth includes the highest frequency bandwidth from among the plurality of frequency bandwidths.

3. The array antenna of claim 1, wherein the plurality of radiators includes a first radiator, a second radiator surrounding the first radiator, and a third radiator surrounding the second radiator, and the at least one switch includes a first switch for connecting the first radiator and the second radiator and a second switch for connecting the second radiator and the third radiator.

4. The array antenna of claim 1, wherein the parasitic element includes at least one second metal plate that is accumulated on at least one radiator from among the plurality of radiators.

5. The array antenna of claim 1, wherein the parasitic element includes at least one second metal plate that is arranged on the first metal plate.

6. The array antenna of claim 1, wherein the parasitic element includes a dielectric material that is formed on at least one of the plurality of radiators.

7. The array antenna of claim 1, wherein the parasitic element includes a plurality of second metal plates that are periodically arranged on at least one of the plurality of radiators.

8. The array antenna of claim 1, wherein the first metal plate has a surface mounted horn structure.

9. The array antenna of claim 1, wherein the antenna element further includes a resonator formed below the first metal plate and filled with a dielectric material.

10. The array antenna of claim 1, wherein in each antenna element, one of the plurality of radiators surrounds another one of the plurality of radiators.

11. The array antenna of claim 1, wherein in each antenna element, at least one of the plurality of radiators surrounds more than one other radiator among the plurality of radiators.

12. In a frequency reconfiguration array antenna, an array antenna comprising a metal plate, and a plurality of antenna elements formed on the metal plate to form an array antenna and arranged according to an array distance, wherein each antenna element includes:

a first radiator;

a second radiator surrounding the first radiator;

a third radiator surrounding the second radiator;

a first switch for connecting the first radiator and the second radiator; and a second switch for connecting the second radiator and the third radiator, and a plurality of frequency bandwidths are configured by the first, second, and third radiators according to the on/off operation by the first and second switch elements, and a gain of at least one of the plurality of frequency bandwidths is higher than gains of other frequency bandwidths.

13. The array antenna of claim 12, wherein the at least one frequency bandwidth includes the highest frequency bandwidth from among the plurality of frequency bandwidths.

14. An antenna element of a frequency reconfiguration array antenna, the antenna element comprising:

a plurality of radiators;

at least one switch for connecting between the radiators, wherein a plurality of frequency bandwidths are formed by the plurality of radiators according to the on/off operation by the at least one switch, and a gain of at least one of the plurality of frequency bandwidths is higher than gains of others of the frequency bandwidths; and a parasitic element for increasing a gain of the at least one of the plurality of frequency bandwidths.

15. The antenna element of claim 14, wherein the at least one frequency bandwidth includes the highest frequency bandwidth from among the plurality of frequency bandwidths.

16. The antenna element of claim 14, wherein one of the plurality of radiators surrounds another one of the radiators.

17. The antenna element of claim 14, wherein at least one of the plurality of radiators surrounds more than one other radiator among the plurality of radiators.

* * * * *